United States Patent [19]

Gunn

[11] Patent Number: 4,955,275

[45] Date of Patent: Sep. 11, 1990

[54] ADJUSTABLE TREMOLO TAIL PIECE

[76] Inventor: Dennis R. Gunn, Tashiro-So East rm.1 1st Fl., Kami Ochiai 2 - 9 - 2, Shinjuku-Ku, Tokyo, Japan

[21] Appl. No.: 147,486

[22] Filed: Jan. 25, 1988

[30] Foreign Application Priority Data

Sep. 17, 1986 [JP] Japan ..... 61-141470

[51] Int. Cl.[5] ..... G10D 3/00

[52] U.S. Cl. ..... 84/313

[58] Field of Search ..... 84/297 R, 313, 205, 84/306, 267 BT

[56] References Cited

U.S. PATENT DOCUMENTS 3,248,991 5/1966 Cole ..... 84/313

4,656,916 4/1987 Gressett, Jr. ..... 84/313

4,677,891 7/1987 Gressett, Jr. et al. ..... 84/313

4,779,506 10/1988 Takeuti ..... 84/313

*Primary Examiner*—L. T. Hix

*Assistant Examiner*—Brian W. Brown

[57] ABSTRACT

A stringed musical instrument comprises means by which the relation between displacement of a hinged string mounting member, such as a tremolo tail piece on which the tuners of the instrument are disposed, and the alteration of pitch of the strings thereof can be adjusted for each of the strings independently of the others. According to another feature of the invention the linear tuner blocks may be selectively released from engagement with the adjuster screws thereof for facilitating quick string mounting operations.

16 Claims, 6 Drawing Sheets

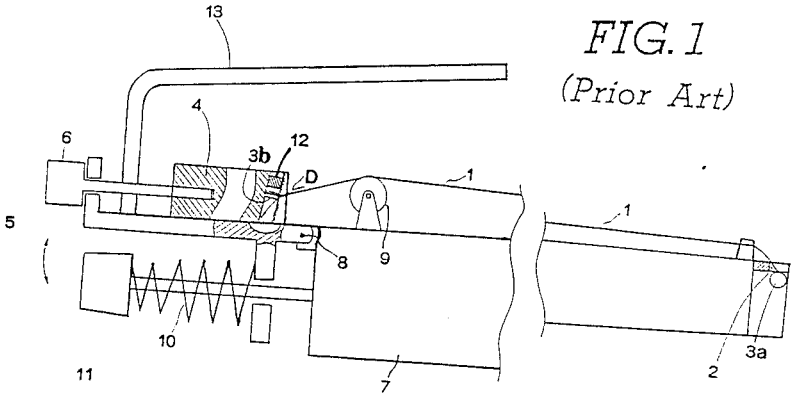
FIG. 1
(Prior Art)
FIG. 2
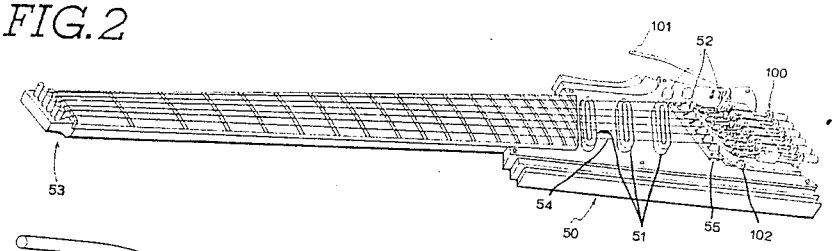
FIG. 3
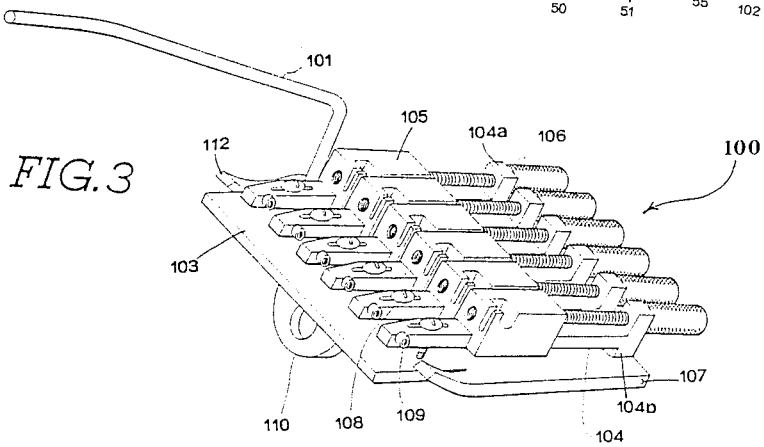

FIG. 16
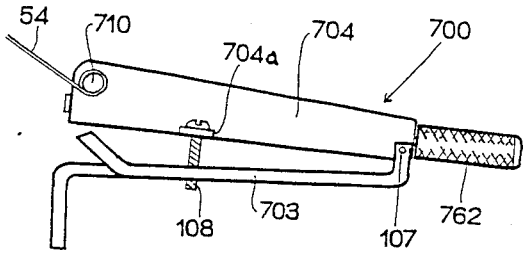
FIG. 17
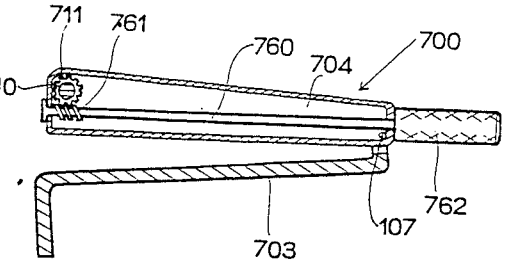
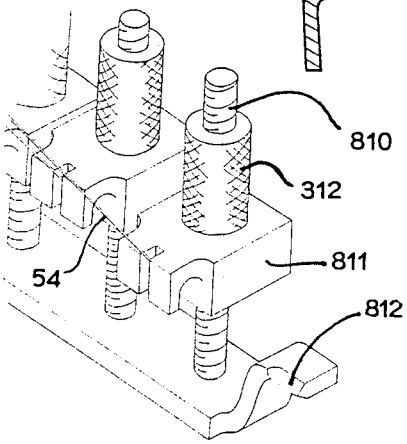
FIG. 18

ADJUSTABLE TREMOLO TAIL PIECE

FIELD OF THE INVENTION

The present invention relates to a device for adjusting the relationship between movement of an oscilating member and the alteration of tension in a filament attached to said oscilating member. More specifically the present invention relates to a device for adjusting a relationship between the relative pitches of the strings of a musical instrument and the position of an oscillating member such as a tremelo tail piece assembly to which the strings are attached.

Prior Art

Recently, musical instruments having devices for temporarily altering the pitch of the tones produced thereby have been enjoying increasing popularity. This is particulary true in the case of electric guitars an increasing number of which are being equiped with tremolo-arm assemblies.

The most common type of tremolo assembly comprises a hinged plate at the bridge end of the guitar to which the strings are attached. This plate is arranged in such a way that the tension force of the strings is balanced against a spring or springs so that the plate is elasticaly retained in a central neutral position. The plate is also equiped with a handle or "bar" which can be manipulated to alter the position of the plate, which has the effect of altering the tension or pitch of the strings of the instrument.

Some of the numerous problems which are commonly associated with the above described type of tremolo arm include:

a tendency for the strings to break due to radical fluctuations in the tension thereof;

a tendency for the strings to become dislocated from their proper positions on the bridge of the guitar since the position at which the strings are attached to the plate can actually become higher than the position of the bridge saddles when the bar is manipulated;

tuning problems due to friction inhibiting the strings passage over stationary members such as the nut and the bridge saddles thereby causing differences in tension between resonating and non resonating sections of the individual strings; and since usually the strings are all of mutually different pitches, thicknesses, and are at mutually different tensions a given amount of displacement of the plate will produce a different amount of pitch change in each of the strings relative to their individual pitches at the neutral plate position therefore the pitch intervals between the strings do not remain constant as the position of the plate is changed, this means that the strings will only be in tune (in terms of both relative and concert pitch) at one position of the mounting plate resulting in tuning problems due to friction at the hinge portion of the plate preventing the plate from accurately returning to the neutral position.

In the prior art various solutions to the above problems have been proposed.

In one prior art system the plate on which the ball ends of the strings of an electric guitar or mounted comprise a set of string guides whose levels relative to the surface of the plate, and cosequently the pivoting axis thereof, are independantly adjustable by means of set screws provided thereon. In this system it is not quite possible to arrange the string guides in such a manner that, upon actuation of the tremolo unit by means of the arm thereof, all of the strings of the instrument change pitch at the same rate, due to the limited degree to which the string guides can be adjusted.

A number of factors limit the adjustment stroke of the string guides of the prior art system described above one of these limiting factors being their size which must be small so that they can be accomodated on the tail piece. Another factor limiting their stroke is their proximity to the anchoring point of the strings on the oscillating tail piece member. Since they are close to the anchoring points of the strings on the tailpeice member, when one of the guides is adjusted so as to be low, if the tailpiece member is actuated so as to be tilted in such a way that its rear side is high and its front side is low,.a point is soon reached in the stroke of the osclating member at which the anchoring point of the string is in direct line with the bridge of the instrument and the string is no longer in contact with the string guide and therefore the setting of the string guide no longer has any effect on the rate of pitch change of the string due to oscillation of the tail peice. If the string guide of the prior art system described above is adjusted so as to be too high on the other hand; oscillation in the above described manner can result in a situation in which the point at which the string passes over the string guide may become higher than the point on the bridge saddle over which the string passes, or in other words a direct line is formed between the nut of the guitar and the string guide and the string no longer contacts the bridge. It will be understood by those skilled in the art that this is not a desirable situation. Further, caution must be taken by the user, when raising the saddle, that the string does not become broken since this adjustment causes a great increase in the tension of the string, particularly in the section of string between the string guide and the anchoring point. This increase in tension is due to the fact that raising the string guide increases the length of the string path and since the string is bent over the string guide at an angle which becomes sharper and sharper as the string guide is actuated upwards, downward pressure on the string guide bY the string, and the resulting increase in friction between the string and the guide prevents the string from sliding over the string guide and tension does not become equal on both sides thereof; the greater part of the increase in tension occurs in the short section of string between the string guide and the anchoring point with the result that the string becomes broken.

Perhaps the most notable of the prior art systems for adjusting the relation between oscillation of the plate and the change of string pitch is the Stienberger "Trans-Trem" (trade name) system for "headless" guitars (patent number unavailable at present) in which, in order to provide a tremolo system which maintains the relative pitch intervals between the strings at any position of the plate, the position of the respective anchoring points of the strings are independantly adjustable relative to the pivoting axis of the mounting plate so that, by raising or lowering the anchoring points of the individual strings relative to the pivoting axis of the plate, the degree to which alteration of the plate's position affects the pitches of the individual strings can be adjusted.

Therefore; with the above system; if it is deemed desirable that the strings maintain a predetermined set of pitch intervals therebetween even while their collective pitches are being altered by actuation of the plate member the respective positions of the anchoring points can can be adjusted accordingly.

Thus in addition to providing an interesting musical effect on actuation of the the bar, this system also has the advantage that, by providing a simple means for altering the tension of the spring, the overall pitch of the instrument can be changed in a single adjustment without disturbing the interval relationship between the strings; this in effect enables "one touch" tuning once the desired pitch relationship has been established between the strings.

In the above system the strings are mounted on slidable block members on the plate which can be slidingly adjusted in the axial direction of the strings to increase or decrease their tension and thus serve as tuners. The block members are equiped with set screws for adjusting the position of the ball ends of the strings in the vertical axis.

A problem encountered with this arrangement is that the range of adjustment of pitch alteration is limited by the length of the space in which the set screws can move and that is limited by the vertical dimentions of the blocks which preferably should not be too great.

Another problem of the above embodiment is that, assuming a case where the strings have been adjusted to change pitch at the same rate upon actuation of the bar, the act of tuning the string tends to alter the distance between the ball end of the string and the pivoting axis of the plate which in turn changes the degree to which alteration of the position of the plate alters the pitch of the string which in turn results in the pitch of the string changing at a different rate than the other strings upon actuation of the bar thus making it necessary to adjust the relationship again. This is troublesome.

One prior art solution to the above problem is to provide strings which are of a precise length and which have ball ends at both ends thereof and to provide means on the guitar for solidly mounting one end of the string via the ball end at a predetermined position. In this way, when the strings are adjusted to a given tension, the position of the ball end relative to the plate will always be the same. Double ball end strings also have the advantage of being quick and easy to mount on the instrument. However, double ball end strings are generallY more expensive and difficult to find for the user than the standard single ball end type which makes this solution somewhat unsatisfactory.

SUMMARY OF THE INVENTION

In veiw of the problems described above in connection with the prior art, it is an object of the present invention to provide a device by which the tension of the strings of an instrument can be altered wherein the relationship between alteration of the position of a hinged string mounting member and the change in pitch of the strings can be adjusted and wherein tuning of the strings does not appreciably alter said relationship.

It is another object of the present invention to provide a device which allows the relationship of alteration of the position of the hinged string mounting member to be adjusted for each string of the instrument independantly and through a broad range.

It is another object of the invention to provide a device for altering the pitch of the strings of an instrument which is particularly suited to headless guitars.

It is another object of an embodiment of the invention to provide an improved headless guitar which incorporates the above described features It is yet another object of the invention to provide an improved linear tuner which incorporates a quick release feature on a tuning block thereof so as to facilitate quick string changing operations.

In accordance with the invention the above objects and others are acheived by providing a hinged string mounting member for a musical instrument comprising;

- a plurality of string guides each of whose magnitude of displacement from the pivoting axis of thereof is adjustable, and
- a plurality of tuning members which may be actuated for adjusting the tension of the strings without effecting the magnitude of displacement of the string guides from said pivoting axis and wherein the strings of the musical instrument are arranged to pass under said string guides and over the bridge saddles of the instrument.

In accordance with another embodiment of the present invention, a hinged string mounting member for a musical instrument comprises:

- a hinged bass plate pivotable about a first axis defined with regard to the main body of the musical instrument
- a plurality of pivoting arm members, pivotable about a second axis defined with regard to the bass plate, having string guiding members provided thereon; and
  - a plurality of slidable tuning members slidably mounted on said pivoting arm members each of which providing means for anchoring an end of a string of the musical instrument and operable bY means of a screw for adjusting the the tension of a respective string of the instrument.

According to another feature of the immediate invention a device is provided for adjusting the tension of a filament comprising,

- a member slidablY adjustable along a defined axis by means of a screw, whereon means for receiving an end of the string is provided and which maY be selectively released from engagement with the screw so as to be able to be slid freelY along the defined axis.

IN THE DRAWINGS

FIG. 1 is a schematic side elevation partially in section of a prior art tremelo system.

FIG. 2 is a perspective veiw of a headless guitar to which a tremolo system according to the immediate invention is mounted.

FIG. 3 is an enlarged perspective view of a tail piece according to a first embodiment of the invention.

FIG. 7 is a partial perspective view of a tail piece according to according to a third embodiment.

FIG. 8 is a perspective view of a string and a mounting screw according to the third embodiment.

FIG. 9 is a sectional veiw of a string guide and mounting screw of the third embodiment.

FIG. 14 is a side elevation of a tail peice according to a sixth embodiment of the immediate invention.

FIG. 15 is a front sectional elevation of a tuner according to the sixth embodiment of the immediate invention.

FIG. 16 is a side elevation of a tail peice according to a seventh embodiment of the immediate invention.

FIG. 17 is a sectional side elevation of the seventh embodiment of the immediate invention.

FIG. 18 is a partial perspective view of a tail piece according to an eighth embodiment of the immediate invention.

DETAILED DESCRIPTION OF THE INVENTION

Figure 4:
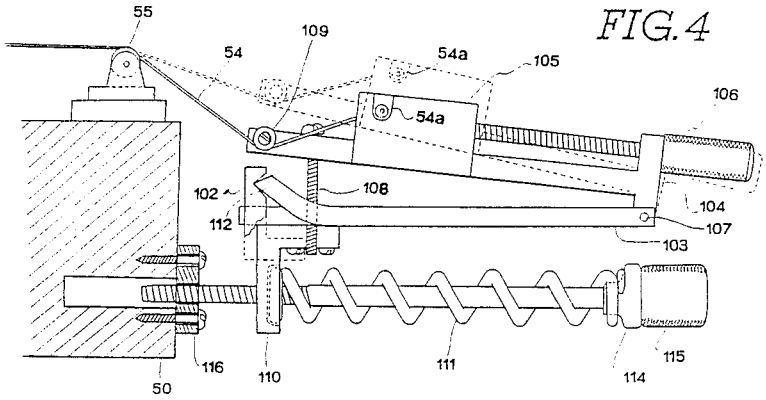
FIG. 4 is a side elevation partially in section depicting the tail piece of the first embodiment mounted to the guitar body.

Making refference to FIG. 1 a tremolo sYstem of a headless guitar according to the prior art is depicted schematically. Each of a plurality of double ball ended strings 1 is mounted to a neck end piece 2 by means Of a groove formed therein for accomodating of the ball end 3*a* of the string 1. The ball end 3*b* at the other end of each of the strings 1 is supported in a threaded groove of a slidable tuning block member 4. The block members are slidably mounted on a hinged plate 5. The position of each tuning block member 4 is adjustable in the axial direction bY means of a finger screw 6 which serves as the tuner for the string 1. The plate 5 is journaled to the guitar body 7 at a pivot point 8.

The tension of the strings 1 which pass over roller bridge saddles 9 is ballanced against a compession spring 10 whose compression force is adjustable by means of a finger screw 11 which serves as a master tuner. Each of the block members is provided a set screw 12 by which the vertical position of the ball end 3*b* within the threaded groove can be adjusted. The plate can be actuated to Pivot by means of a bar !3 and upon releasing the bar the plate 5 will elastically return to a neutral position at which the force of the strings and that of the spring ballance against each other.

It will be seen that as the distance of the ball end 3*b* from the bridge saddle 9 increases or decreases so does the tension and therefore the pitch of the string.

It will also be seen that adjustment of the position of the ball end 3*b* of the string 1 by means of the set screw 12 alters the distance of the ball end 3*b* from the pivot axis defined at the pivot point 8 and therefore the distance of travel of the ball end 3*b* in the directions indicated by the arrows D upon oscillation of the plate 5. Therefore, the degree to which alteration of the position of the plate 5 alters the pitch of the individual strings 1 can be adjusted by means of the set screw 12. However it can also be seen that tuning of the instrument, which is accomplished by adjusting the position of the block member 4 also alters the distance between the pivot axis 8 and the ball end 3*b* of the string 1 and therefore also alters the degree to which oscillation of the plate member about the axis 8 effects the pitch of the string 1 making it necessary to readjust the position of the ball end 3*b* of the string within the block 4 by means of the set screw 12 if a predetermined relationship is to be maintained. This is time consuming and troublesome.

It will be noted that the degree to which the set screw 12 may be adjusted is determined by the length of the threaded hole in the block which in turn is limited by the thickness of the block 4 which in the interest of keeping the tail piece light and compact is limited there the magnitude of adjustment of set screw is greatly limited.

In FIG. 2 a headless guitar comprising a tail piece according to the first embodiment of the immediate invention is depicted.

At the nut end of the guitar a clamping means is provided for immovably clamping a section of each of the strings of the guitar this clamping means may be comprised of a simple arrangement of a screw threaded into a hole in a block, a section of the string is arranged between the bottom of the head of the screw and the surface of the block immediately surrounding the hole and the screw may be tightened so as to clamp a section of the string between the head of the screw and the block a washer or other member may be disposed between the head of the screw and the string if desired. The above described clamping arrangement is well known in the art and comprises no part of the invention. The inventor has described other means for anchoring a guitar string at the nut end of a stringed instrument in another patent application, Ser. No. 089,505 filed Aug. 26, 1987. It will be understood by those skilled in the art that the means described in that document may also be applied to a guitar comprising a tail peice according to the immediate invention, however, the nut end anchoring means forms no part of the immediate invention and shall not be gone into in further detail.

In FIG. 2 a clamping means 53 of the above mentioned or similar type retains the strings of the instrument at the nut end of the neck thereof. 0n the main body of the guitar 50 are mounted a set of magnetic coil type pickups 51 and pickup tone and volume controlling means 52 of an essentiallY standard and well known type. A clamping means 53 of a type similar that described above is depicted as being disposed at the nut end of the guitar 50 and clampingly engages the strings 54 of the guitar at the nut end thereof so as to firmly fix them in place. The strings 54 may be considered, for the purpose of this disclosure, to be of the single ball end type, however the invention should not be taken to be limited to use with such.

At the bottom end of the guitar 50 adjacent the bridge 55, which in the pictured embodiment is a roller type for reduced friction, a tailpeice 100 according to the invention is depicted. The tailpeice generally designated by the number 100 is equiped with a handle 101 by which it may be manualy oscillated about an axis defined at a pair of pivot mounts 102 for altering the tension of the strings 54.

Referring now to FIG. 3, which is an enlarged veiw of the tailpeice dePicted as being removed from the guitar, the details of the tailpeice 100 may be appreciated.

The tailpeice comprises a plate 103 to which are mounted a plurality of horizontal "T" shaped arm members 104 each of which accomodates a slotted tuning block 105 on its upper surface.

In this embodiment a tuner comprises the pivoting T shaped arm 104, the finger screw 106, the block 105, and the guide 109.

Each of the slotted tuning blocks 105 has a threaded hole formed parallel to the surface of the T shaped member 104 onto which it is mounted and a slot formed in its bottom side for slidablY accomodating the upper portion of the long arm of the T shaped member so as to maintain alignment between the slotted tuning block 105 and the T shaped member 104. The block 105 has a section at its front portion designed to accomdate and retain the ball end 54*a* of a string 54. A finger screw 106 passes through a hole formed in an upward projecting section 104*a* of the T shaped member 104 and is recieved in a threaded hole in the block. Thus the finger screw 106 is operable for adjusting the position of the block 105 on the arm of the pivoting member 104 and thereby the tension of a string 54 whose ball end 54*a* is retained at the front portion thereof.

The plate 103 is crenelated at its rear portion so a to accomodate downward projecting portions 104*b* of the T shaped members 104 in the recesses between the projecting portions. A hole is formed through the crenelated section of the plate running parallel to the upper and lower surfaces and rear edge thereof for accommodating a pin 107. The downward Projecting sections 104*b* of the T shaped members 104 have holes formed therethrough by which they may be journaled onto the pin 107. Thus the T shaped members are pivotably mounted at the rear of the plate 103 so as to pivot around the axis defined by the pin 107.

The T shaped arm members 104 have formed at their front ends longitudinal slots arranged normal to the surface of the Plate 103. Adjusting screws 108 pass through the longitudinal slots in the T shaped members 104 and are received in threaded holes in the plate 103. Thus the adjusting screws are operable for limiting the degree to which the long arm of the T shaped members 104 can pivot upwards away from the surface of the plate.

String guides 109, Which, in the pictured embodiment are annular grooved rollers whose rotating axes are essentially parallel that of the T shaped members, are provided near the front end of the T shaped members. It will be noted that the string guides 109 in the shown embodiment are formed at the side of the T shaped member in such a way that at any position of the block there is a direct path between a ball end receiving section of the block 105 and the string guide 109. It would also be possible in cases were economic considerations dictate reduced cost, that the string guides take the form of fixed protrusions formed on the side of the T shaped member 104 however experiment has shown that the best results are obtained when the string guides offer the least possible resistance to the passage of the string 54 thereover in the longitudinal direction thus preventing any tendencY of the strings to bind.

It has also been found that the best results, in terms of maintaining equal tension between the resonating or "speaking" section of the string and the "non-speaking" sections thereof, are obtained when the length of the latter portions is kept to a minimum. It will be appreciated by those skilled in the that this relationship is important in that when it becomes inequal the tuning of the instrument is affected.

Formed at the sides of the plate 103 is a pair of blades 112 the front edges of which are coaxially alligned so as to define the pivoting axis about which the plate 103 can oscillate.

Projecting from the bottom of the plate 103 is an ear 110 against which the ballancing force of a spring 111 can be applied.

Referring now to FIG. 4, which is a side elevation partially in section depicting the first embodiment of the immediate invention as it would appear mounted on a guitar, the effect of the invention can be appreciated.

The strings 54 (only one of which is described for clarity) are anchored at one end (not shown) bY a mounting means provided at the end of the neck and are arranged in a string path defined, at the bridge end thereof, by the upper side of a bridge saddle of the bridge 55 and the lower side of a string guide 109 and the ball end 54*a* is received in an anchoring section of a block 105.

The tension of the string guide !09 tends to elastically bias the long arm of the T shaped member 104 upwards from the position shown, so that the free end pivots away from the surface of the plate 103 until a position (depicted in phantom lines) is reached where the section of the string between the bridge saddle of the bridge 55 and the string guide 109 defines a more or less straight line between the bridge saddle and the pivoting axis of the T arm 104 of the tuner on the plate 103 defined by the pin 107. The upward bias of the T arm 104 may be used to urge it against the bottom of the head of the adjusting screw 108 around which a spring (not shown) may also be provided to bias the T arm 104 against the screw 108 in the absence of the string. As another alternative a stop ring or circlip may be provided on the adjusting screw immediately under the T arm so as to restrict downward movement thereof. The adjusting screw 108 is thus operable for defining the position of the string guide 109 of the tuner relative to the pivoting axis of the plate 103.

As can be seen a compression spring 111 is provided for applying a ballancing force against the ear 110 to offset the tension force of the strings 54 and the combined forces of the strings 54 and the spring serve to drive the pivot blades of the of the plate into V-grooves formed on the pair of pivot support members 102 provided on the guitar body for receiving the pivot blades. The angle between the inner surfaces of the V-grooves of the pivot support members is greater than the angle between the upper and lower surfaces defining the blades 112 and the V-grooves of the pivot supports 102 are coaxially alligned so as to define the pivoting axis of the plate with respect to the guitar body 50.

At its end opposite that which abuts on the ear, the compression spring 111 abuts on an annular or frustal shaped ring member 114 provided on a finger screw 115 for maintaining the spring 111 in coaxial alignment with the finger screw 115. The finger screw 115 threads into a threaded member 116 provided on the guitar body 50, and is rotatable for adjusting the tension of the spring 111 and since the spring 111 ballances the tension of the strings 54 the finger screw 115 can, in the pictured embodiment, be made to effectively serve as a master tuner for transposing all of the strings 54 simultaneously in a single operation.

It will be seen that as the tuner, is operated to draw the string taught or to loosen the string 54, the distance between the ball end 54*a* of the string and the string guide 109 increases but the distance of the string guide 109 from the pivoting axis defined by the blades 112 of plate is uneffected.

It may also be seen that oscillation of the plate 100 about its Pivoting axis will cause the distance between the string guide 109 and the and the bridge saddle of the bridge 55 to fluctuate but the distance of the ball end 54*a* from the string guide 109 will remain uneffected.

Therefore, upon oscillation of the plate, fluctuation in the length of the string path occurs only in the area between the string guide 109 and the bridge saddle regardless of the position of the tuning block.

If desired, with this type of arrangement, the tuner can be made to be adjustable to any position between a point where the string guide 109 is actually below the pivoting axis of the plate and a point whose distance above the pivoting axis essentially limited only by the length of the adjusting screw. This means that, for example, if so desired, the string guide of one of the strings could be set below the pivoting axis of the Plate while those of the others are set above so that oscillation of the plate would cause the pitches of the strings whose guides were arranged above, the pivoting axis to change a direction opposite that of the string arranged below it.

Further, since the tuning block 105 is arranged to be higher than the string guide on the arm, as the position of the T arm becomes higher for raising the position of the string guide so does the position of the tuning block so there is never a situation during normal operation where the tuning block is directly in line with the bridge saddle with regard to the string path, and the string always is in positive contact with the string guide, therefore the pitch changing characteristics of the string always have a consistant relation to the pivot stroke of the plate.

Having discussed the basic principles of the invention in connection with the first embodiment further embodiments shall herinafter be discussed.

For clarity the ,drawings of the following embodiments will include only the the base plate member and those parts which are mounted thereon. The spring arrangement, including the compression spring 111 and the pivot mounts, may be considered to be the same as those depicted in connection with the first embodiment, however, it will be obvious to those skilled in the art that other spring and pivot arrangements may be employed without departing from the principles of the invention. In order to aviod redundancy perspective veiws of the following embodiments will be partial veiws of the plate and connected parts. It will be understood that in the drawings like numerals denote like parts.

Figure 5:
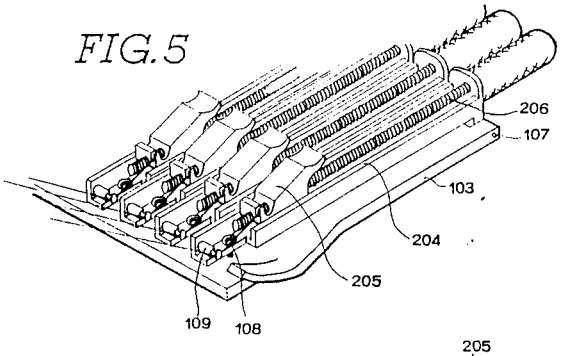
FIG. 5 is a partial perspective view of a tail piece according to a second embodiment of the invention.
Figure 6:
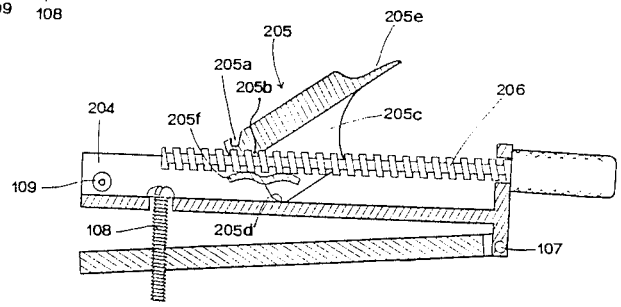
FIG. 6 is a sectional side elevation of the tail piece according to the second embodiment of the immediate invention.

Hereinafter, a second embodiment, which is the preferred embodiment, is discussed with refference to FIGS. 5 and 6, in which the block member and the arm member of the tuner have been modified to facilitate quicker string changing operations. In the second embodiment, the parts other than those comprising the tuner are essentially the same as those described in connection with the first embodiment, therefore redundant description thereof will be deleted and it will be understood that as mentioned above like numerals as in FIGS. 2–4 depict like parts.

The arm member 204 of a tuner according to the second embodiment of the invention is formed with a longitudinal channel on the upper side thereof, for defining a path within which the tuning block 205 maY slide, but is otherwise basically similar in form and function to that of the first embodiment.

The tuning block 205 according to the second embodiment comprises a Pair of parallel flanges or shoulders 205*c* projecting downwards so as to define a longitudinal slot therebetween. The slot, defined between the flanges, is wide enough to accomodate the finger screw 206 therein.

At the forward section of the block 205, immediately under a string mounting portion 205*a*, a semi-cilyndrical threaded section or half nut 205*b*, whose threads can mate with those of the finger screw 206, is formed. The half nut section 205*a* is formed so that its axis is aligned within a plane generally defined between the parallel flanges 205*c* of the block 205 but is at an angle to the innermost wall defining the top of the slot.

The bottoms of shoulders 205*c* are so formed as to run basically parallel to the top most inner wall of the slot at a distance therefrom that is slightly greater than the distance from the top of the threaded section of the finger screw 206 to the bottom of the slot in the arm 204, and have defined at one section thereof rounded transitional or pivoting sections 205*d*.

The transitional sections 205*d* are formed so as to allow the block 205 to rock or pivot in the groove of the arm 204 relative to the finger screw 206, in such a way that the tension of the string 54 elastically urges the half nut section 205*b* down onto the finger screw 206 and the threads of the half nut section 205*b* are thus held in engagement with those of the finger screw 206.

A handle 205*e* is defined at the top of the block 205, by which the block 205 may be actuated to rock on the transition sections 205*d* of the flanges 205*c* to a position in which the flat sections of the flanges which run parallel to the the inner top surface of the slot rest flat on the bottom of the guide groove formed on the T arm member 204. In this position the threads of the half nut 205*b* are disengaged from those of the screw 206 and the block is thus free to slide longitudinally in the guide groove of the arm 204.

If deemed necessary the threads of the finger screw 206 and of the half nut 205*b* may be of the type which is square in cross section as those pictured so that the faces of the threads are not inclined in such a way that the block 205 might be caused to pivot out of engagement by a wedge effect occuring therebetween.

In the shown embodiment, a spring member 205*f*, (seen only in cross section in the drawing) which when viewed from above describes a T shape, is provided on the block 205, serves the dual functions of supporting the screw 206 against the downward force of the threaded section 205*b* of the block 205 and increasing the downward force of the threaded section 205*b* of the block 205 on the screw 206. This is accomplished by providing a pair of slots (not shown) in the flanges 205*c* in which the shoulders of the T shaped spring 205*f* can be accomodated so as to be rearward of the area of the block 205 about which the block 205 pivots relative to the screw 206. When the block 205 is in a position where the threads thereof are engaged with those of the screw 206, a section of the spring 205*f* which is directly between the shoulders of the spring 205*f*, and being thus supported is virtually inflexable, is against or very near the bottom of the screw 206 thus preventing the screw 206 from moving downwards under the downward force of the half nut section 205*b* and a forward projecting section of the spring 205*f*, which projects forward of the area about which the block 205 pivots, exerts an elastic force on the bottom of the screw 206 which tends to drive it into engagement with the half nut 205*f*. This also serves to elastically drive the half nut 205*b* into the engaged position in the absence of the of the string 54.

Thus, in this embodiment, the speed with which a string may be changed can be increased since the block 205 can be moved to the position in which it is closest tO the string guide, herein referred to as the starting position, quickly, and without using the finger screw 206, by actuating the handle 205*e* so as to disengage the threads of the block member 205 from those of the screw 206 and sliding the block 205 to its starting position, while the threads are thus disengaged. Once the block 205 is in the starting position a string end 54 may be mounted in the string mounting portion 205*a* at the front of the block 205. The string 54 is then arranged in the string path, drawn somewhat taught and then fastened at the nut end of the guitar. The tension of the string exerts a downward force on the threaded half nut section 205*b* of the block 205 which holds the threads of the block 205 in engagement with those of the screw 206 so that the position of the block 205 is adjustable (in other words the guitar can be tuned) by means of the finger screw 206.

Referring now to FIGS. 7, 8 and 9 a third embodiment of the immediate invention is described In a third embodiment the tuning block is essentially the same as that (205) described in connection with the second embodiment however, the T arm members are not provided, instead the tuning screws 206 are mounted directlY on a upwardlY projecting portion 300*a* formed at the back of the pivoting plate 300 and the slots for guiding the blocks are formed directly on the upper surface of the plate 300.

The string guides 309 of the third embodiment are mounted on upwardly projecting screw members 310 provided at the front of the plate. Key grooves 310*a* are formed in the upwardly projecting screw members 310 by which the string guides 309 may be maintained in a predetermined alignment so as not be rotatable about the screw members 310. Preferrably the longitudinal axes of the screws 310 intersect the pivoting axis of the plate 300.

In the pictured embodiment each of the individual string guides 309 comprise a block 309*a* through which a nonthreaded hole, large enough to accomodate a screw member 310 and a smaller threaded hole, whose axis intersects that of the non threaded hole are formed in the block. A grooved roller 309*b* is mounted onto the block by means of a screw 309*c*. When the screw 309*c* is threaded into the block 309*a* its end is recieved in the key groove 310*a* and thus the string guide 309 held in a predetermined alignment on the screw 310. A manually operable nut 312 is provided on the screw 310 above the string guide 309 for adjusting the position of the string guide 309 along the axis of the screw 310.

As in the previously described embodiments, a string path is defined from the tuning block 205, under the string guide roller 309*b*, over the bridge saddle (not shown) and the nut (not shown) to an anchoring means at the end of the neck (not shown). The tension of the string 54 against the bottom of the string guide 309 urges the string guide against the bottom of the nut 312 and the nut 312 is operable for adjusting the position of the string guide 309 relative to the pivoting axis of the plate 300. A compression coil spring (not shown) may also be provided, arranged coaxially about the screw 310, for holding the string guide 309 against the bottom of the nut 312 in the absence of a string 312.

Thus as in the above described first and second embodiments, the third embodiment is effective for adjusting the relationship between oscillation of the plate and the resulting variation in pitch of the string and as in the second embodiment the block is formed so as to provide the quick release feature.

As will be easilY appreciated by those skilled in the art the tuning blocks described in connection with the third embodiment might also take a form similar to those described in connection with the first embodiment in cases where it is deemed unnessary to provide the quick release feature.

As an alternative the tuners might also take a form comprising rotatable tuner barrels mounted on the plate should it be deemed desirable.

It will be appreciated by those skilled in the art that the quick release principle embodied by the tuning members 205 of the second and third embodiments may also be used to advantage in any instrument having a linear type tuner and the utility is in no way limited to the embodiments described above or to instruments on which oscillating tailpeices are provided.

Figure 10:
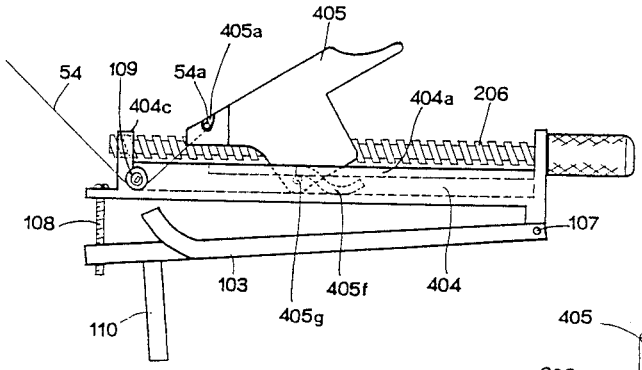
FIG. 10 is a side elevation of a tail piece according to a fourth embodiment of the immidiate invention.
Figure 11:
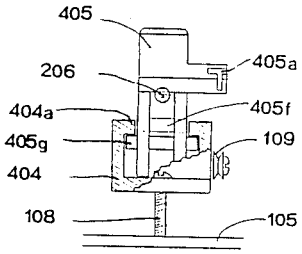
FIG. 11 is a front elevation partially in section of a tuner according to the fourth embodiment of the immediate invention.

In a fourth embodiment shown in FIGS. 10 and 11 a pivoting arm member 404 is provided which is basically similar in function to the T arm of the second embodiment, the longitudinal channel formed thereon for defining the path within which the tuning block 405 may slide, has inwardly projecting shoulders 404*a* defined at the top side thereof in such a way that the channel is of a predetermined width at the top thereof and is of a greater width thereunder.

The tuning block 405 of the fourth embodiment is basically similar to that of the second embodiment however a pin 405*g* is provided which passes through the lower section of the flanges. The pin 405*g* is longer than the width of the section of the slot of the arm member between the inward projecting shoulders 404*a* but shorter than the width of the recess therebeneath.

A gap may be provided at a section of the the shoulders so that the tuning block 405 can be inserted into the slot. Thus, while the tuning block 405 is at any position in the slot at which the shoulders 404*a* are provided, the pin 405*g* retains the tuning block 405 within the slot.

A section 404*c* is formed at the front end of the pivoting arm 404 so as to support an end of the finger screw 206 against the downward pressure exerted on the block 405 by the string 54 and or a spring 405*f* and transmitted to the screw by the block.

A spring 405*f* similar to that 205*f* described in connection with the second embodiment, may be provided on the block, however the provision of such is optional. Where provided, the spring 405*f* may be arranged so as to exert an elastic force against the bottom of the slot at a position on the oposite side of the pin 405*g* from the half screw section of the block 405. Thus, with this arrangement the pin is elastically urged against the bottoms of the of the shoulders 404*a* of the arm member 404 and serves as a fulcrum about which pressure of the spring 405*f* is translated so as to be caused to urge the half nut section of the block 405 against the upper side of the screw 206 and thus no portion other than the threaded portion of the block 405 is caused to be in contact with the screw 206 and therefore friction between the block 405 and the screw 206 is minimized.

Figure 12:
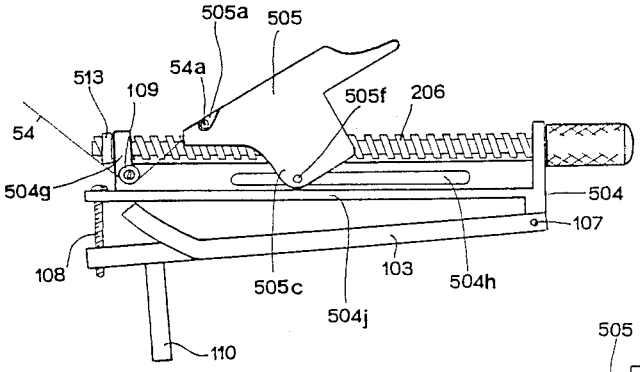
FIG. 12 is a side elevation of a tail piece according to a fifth embodiment of the immediate invention.
Figure 13:
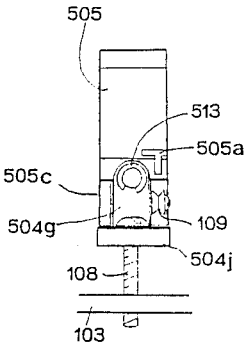
FIG. 13 is a front elevation of a tuner according to the fifth embodiment of the invention.

In a fifth embodiment shown in FIGS. 12 and 13 a section of the pivoting arm 504 beneath the finger screw 206 has an oblong hole 504*h* formed therein and is narrow enough to fit between the shoulders 505*c* of the block 505 which is essentiallY identical to that 405 of the fourth embodiment except the pin 505*f* can be shorter so as not protrude at the sides of the block 505.

Immediately under the section of the arm 504 in which the oblong hole **504*h* is formed are a pair of steps or shoulders 504*j* on which the flanges 505*c* of the block 505 can ride. The oblong hole 504*h* serves to retain the pin 505*f* on the pivoting arm similar to the manner in which the shoulders 404*a*** of the slot do in the fourth embodiment.

It will be noted that the embodiment shown a retaining ring 513 is provided on the screw 206 just in front of the section **504*g* of the arm for retaining the screw 206 on the arm 504**.

Provision of the shoulders on the pivoting arm of the fifth embodiment is optional.

In a sixth embodiment shown in FIGS. 14 and !5 the pivoting arm of the tuner is essentially similar to that of the fourth embodiment however instead of the inwardly projecting shoulders **404*a* oblong holes 604*h* are formed in the walls defining the guide slot for the block 605 this configuration allows the pivot arm 604 to be made a little narrower than that 404** in the fourth embodiment.

A member 605, which is essentially an inverted U shape in cross section, is arranged in the slot in the T arm member. Protrusions or flanges **605*a* at the sides of the U shaped member 605 are formed so as to project into the oblong holes 604*h* in the walls of the slot to retain the U shaped member 605 in the slot in the arm 604. A space is defined within the U shaped member above the the screw 206, in which a section of of a pivoting member 615 can be accomodated. A coaxially aligned pair of holes 605*h* are formed in the sides of the U shaped member 605 for accomodating a journalling pin 615*a* of the pivoting member 615. The pivoting member 615 is formed at its front end with a half nut section 615*b* which may engage with the screw 206, a central section at which it is journaled onto the U shaped member via pin 615*a* and a handle 615*c* actuable for disengaging the half nut section 615*b* from the screw 206. A spring (not shown) maY be provided for elastically holding the half nut section in engagement with the screw. A section may be provided on the pivoting member 615 for retaining the ball end 54*a* of the string 54 or the means for retaining the ball end 54*a* of the string 54 may be formed directly on the the U shaped member 605** in the pictured embodiment the latter is the case.

In a seventh embodiment of the immediate invention shown in FIGS. 16 and 17 each of a plurality of tuners 700 comprise a pivoting arm member 704 whose function is essentially similar to that of the pivoting arm members described in connection with the first, second, fourth, fifth and fifth embodiments, and a rotating type tuner string barrel 710 with a hole not shown running therethrough for recieving a section of string 54. The string barrel 710 of the tuner protrudes horizontally from the side of the pivoting arm member 704 at roughly the same position and orientation as the string guide 109 in the previously described embodiments. As in the first, second, fourth, fifth and sixth embodiments the arm member 704 is pivotable relative to the plate and is adjustable by means of the screw 108. In the shown embodiment a slot is formed in a protrusion **704*a* provided at the side of the pivoting member 704 for accomodating the screw 108. At the position occupied by the tuner screw 206 in the first and second embodiments, is a shaft 760 with a worm gear 761 provided thereon which engages a helical gear 711 provided at the base of the string barrel 710. A handle 762 is provided on the on the shaft 760 by which the string barrel 710 may be actuated to rotate for winding a section of string 54 thereabout. Thus the tuner 700 functions in essentially the same manner as an ordinarY rotarY type guitar tuner however, it is mounted on the oscillating tailpeice 703 and its position relative to the pivoting axis thereof is adjustable in the same manner as that of the string guides 109** of the first, second, fourth and fifth embodiments described above.

It will be noted that the plate 703 is essentially the same as the plate 103 of the previously described embodoments, however the crenelated section at the rear of the plate which supports the pin 107 is formed so as to project upwards from the surface of the plate thus eliminating the need for a downwardly projecting journaling section on the pivoting arm member 704.

It will be understood by those skilled in the art that different gearing arrangements may be employed to reduce the width of the section of the tuner on which the string barrel is supported, to provide the desired gear reduction and if desired to arrange the handles of the tuners at mutually different angles so as to make them more easily individually accessable.

It is also possible to form the section **704*a* of the arm 704 in such manner as to be operable to be temporarily released from engagement with the screw to allow the pivoting arm 704** to be pivoted to whatever position the user finds most convenient for performing the string mounting operation.

It will be noted that with this embodiment simple means may be provided for retaining the ball end of the string at the nut end of the guitar and the relatively complicated means for clamping the string or the use of double ball end strings is rendered unnecessary.

In the eighth embodiment depicted in FIG. 18 no tuners are provided on the pivoting plate 803 and upwardly protruding members 810 similar to those 310 in the third embodiment are provided on the pivoting plate 803. The upwardlY protruding screw members 810 have a similar relationship to the pivoting axis of the plate 803 to that of those 310 with the plate 303 in the third embodiment. The plate 803 is basically similar to that 303 exept that the section at the rear on which the tuning blocks and tuning screws are provided on the plate 303 is omitted, instead, conventional rotary tuners (not shown) are provided on the head of the guitar (not shown) in the manner of traditional guitars. The pivot blade 812 functions in essentially the same manner as that 112 of the other embodiments and the spring arrangement (not shown) at the bottom of the plate may, for convenience and in order to avoid redundant disclosure be considered to be the same as that of the previously disclosed embodiments. Blocks 811 comprising string end receiving sections and formed with holes therethrough for receiving the screw members 810 are provided on the on the screw members and their positions are adjustable along the axis of the screw members 810 by means of a nut 312 similarly to the string guide 309. Alternatively the screw member 810 may be a rotatable finger screw and the nut may be omitted in leu of a head (not shown) on the screw. Thus similarly to the string guides of the third embodiment the anchoring members 811 of the eighth embodiment are adjustable for adjusting a section of the string path in relation to the pivoting axis of the pivoting member so as to adjust the relationship between displacement of the pivoting plate and alteration of pitch of the strings 54 the only significant difference being that the adjusted section is that section of the string at the tail peice end the end of the string path.

It will be understood by those skilled in the art that means may be provided in connection with any of the above embodiments, which is selectively operable for locking the plate member at an adjustable predetermined position in its pivoting stroke.

It will also be understood by those skilled in the art that although the tuners in the above described embodiments 1-7 have been disclosed as rotary and linear types embodiments are also possible in which the tuners comprise of lever type tension adjusting means without departing from the princiPles of the invention.

It will also be appreciated by those skilled in the art that the principles employed in the tailpeices of the above first through seventh embodiments may be embodied in various ways without departing from the principles of the immediate invention as defined in the amended claims and the embodiments described above are intended as examples and are not intended to imply limitation of any kind.

What I claim is:

1. A string mounting member pivotably mounted on a stringed instrument comprising, a first member pivotably mounted with respect to the main body of said instrument for pivoting relative to a bridge saddle mounted on said body over which a string of said instrument passes; and a plurality of tuners provided on said first member for adjusting the tension of the strings of said instrument wherein at least one of said tuners comprises a section having a lower surface by which a string path of a string of said instrument is defined, the position of which section relative to the pivoting axis of said first member being adjustable independantly of that of the other tuners of said instrument, and wherein actuation of said tuner for adjusting the tension of said string does not affect the positional relationship between said section and said pivoting axis.

2. A string mounting member as set forth in claim 1 wherein at least one of said tuners comprises a pivoting means for allowing it to pivot relative to said string mounting member.

3. A string mounting member as set forth in claim 1 wherein said section having said lower surface for defining said string path is defined by a tuner barrel about which a string may be wound and which is rotatably operable for adjusting the tension of a string of said instrument.

4. A string mounting member as set forth in claim 1 wherein said section adjustable relative to said pivoting axis is defined by a string guide and wherein said tuner further comprises a member on which a string end may be secured which is operable to slide along an axis defined so as to lengthen or shorten a string path of a string of said instrument for adjusting tension of said string.

5. A string mounting member as set forth in claim 4 wherein said slidable member is adjustable by means of a screw.

6. A string mounting member as set forth in claim 5 wherein a threaded section of said slidable member is selectively releasable from engagement with the threads of said screw.

7. A string mounting member as set forth in claim 6 wherein said string guide means is provided on a pivoting arm member of said tuner.

8. A string mounting member as set forth in claim 7 wherein said slidable member is disposed on said pivoting arm member of said tuner.

9. A string mounting member as set forth in claim 7 wherein said string guide means is disposed so as to be adjustable along an axis defined by a screw member.

10. A string mounting member as set forth in claim 9 wherein said screw member protrudes from said first member substantiallY normal to the pivoting axis thereof and has defined thereon a keY groove bY which the string guide may be maintained in a predetermined alignment thereon.

11. A string mounting member as set forth in claim 1 wherein a spring means is provided for elastically biasing first member against tension exerted thereon by a string of said musical instrument.

12. A string mounting member as set forth in claim 11 wherein the biasing force of said spring means is adjustable.

13. A string mounting member as set forth in claim 1 comprising a handle by which it may be actuated to pivot relative to the main body of said musical instrument.

14. A hinged string mounting member for a musical instrument comprising;

a pivoting body which is pivotably movable with respect to a bridge saddle of said instrument;

a plurality of string guides mounted on said pivoting body each of whose magnitude of displacement from the pivoting axis of said hinged string mounting member is adjustable, and a plurality of tuning members operable for adjusting the tension of the strings of a musical instrument wherein actuation of said tuning members for adjusting said tension does not effect the magnitude of displacement of said string guides from said pivoting axis and wherein the strings of said musical instrument are arranged to pass under said string guides and over the bridge of said instrument.

15. A hinged string mounting member for a musical instrument comprising;

a hinged bass plate pivotable about a first axis defined with regard to the main body of a musical instrument;

a pivoting arm member, pivotable about a second axis defined with regard to said bass plate, having a string guiding member provided thereon a slidable tuning member slidably mounted on said pivoting arm member so as to be movable along a longitudinal axis thereof and having defined thereon; are means for archoring an end of a string of said musical instrument.

16. A hinged string mounting member for a musical instrument comprising:

a pivotable plate;

a screw member protruding from a surface of said pivotable plate;

a rigid string end anchoring member disposed on said screw member so as to be adjustable along the axis of said screw for adjusting the distance between the pivoting axis of said pivotable plate and a string anchoring point defined on said rigid string anchoring member between a condition wherein said string anchoring point is located substantially on said pivoting axis and a condition wherein said string anchoring point is offset from said pivoting axis.

* * * * *